US006141922A

United States Patent [19]

Carlisle et al.

[11] Patent Number: 6,141,922

[45] Date of Patent: Nov. 7, 2000

[54] TRIM ASSEMBLY AND METHOD OF MANUFACTURE

[75] Inventors: Lewis B. Carlisle; Larry E. Parrella, both of Louisville, Ky.

[73] Assignee: Tempco Products Company, Robinson, Ill.

[21] Appl. No.: 09/107,513

[22] Filed: Jun. 30, 1998

(Under 37 CFR 1.47)

Related U.S. Application Data

[60] Provisional application No. 60/052,781, Jul. 2, 1997.

[51] Int. Cl.[7] ..... E06B 1/04

[52] U.S. Cl. ..... 52/204.1; 52/211; 52/212; 52/204.53; 52/656.4; 52/656.2; 52/656.5; 52/656.6; 52/745.16

[58] Field of Search ..... 52/204.1, 211, 52/204.53, 656.2, 656.4, 656.5, 656.6, 212, 745.16

[56] References Cited

U.S. PATENT DOCUMENTS

| | | | |
|---|---|---|---|
| 2,902,727 | 9/1959 | Samolis . | |
| 3,217,921 | 11/1965 | Frehse . | |
| 3,378,958 | 4/1968 | Parks et al. . | |
| 3,862,535 | 1/1975 | Byssing . | |
| 3,864,889 | 2/1975 | Hobbs . | |
| 3,868,789 | 3/1975 | Gates . | |
| 3,943,679 | 3/1976 | Dissinger . | |
| 4,119,325 | 10/1978 | Oakley et al. . | |
| 4,259,813 | 4/1981 | Winner et al. . | |
| 4,280,309 | 7/1981 | Huelsekopf . | |
| 4,328,644 | 5/1982 | Scott et al. . | |
| 4,407,100 | 10/1983 | Huelsekopf . | |
| 4,492,063 | 1/1985 | Schock et al. . | |
| 4,831,781 | 5/1989 | Morton . | |
| 4,875,318 | 10/1989 | MacLeod et al. . | |
| 4,972,640 | 11/1990 | DiFazio . | |
| 5,115,605 | 5/1992 | Butler . | |
| 5,345,722 | 9/1994 | McKann . | |
| 5,570,548 | 11/1996 | Hopper | 52/204.5 |
| 5,603,585 | 2/1997 | Bruchu et al. | 403/382 |
| 5,857,299 | 1/1999 | Gyllenberg et al. | 52/217 |

*Primary Examiner*—Christopher T. Kent
*Attorney, Agent, or Firm*—King and Schicki, PLLC

[57] ABSTRACT

A trim assembly is provided for installation in a wall opening, such as a recessed window frame or walk-through doorway. The trim assembly includes a jamb extension assembly for covering the interior surface of the wall opening and one or more casing assemblies for covering the wall at one or both sides of the wall opening. Both the jamb extension assembly and casing assembly are made of solid cellular foam polyvinyl chloride (PVC) or polystyrene members having miter cut and welded corners. The specific material allows for the construction of a strong, yet lightweight pre-finished one-piece assembly for easy and efficient installation in a window or door opening independent of any window or door structure. A method for manufacturing the trim assembly and curved portions thereof is also disclosed.

11 Claims, 8 Drawing Sheets

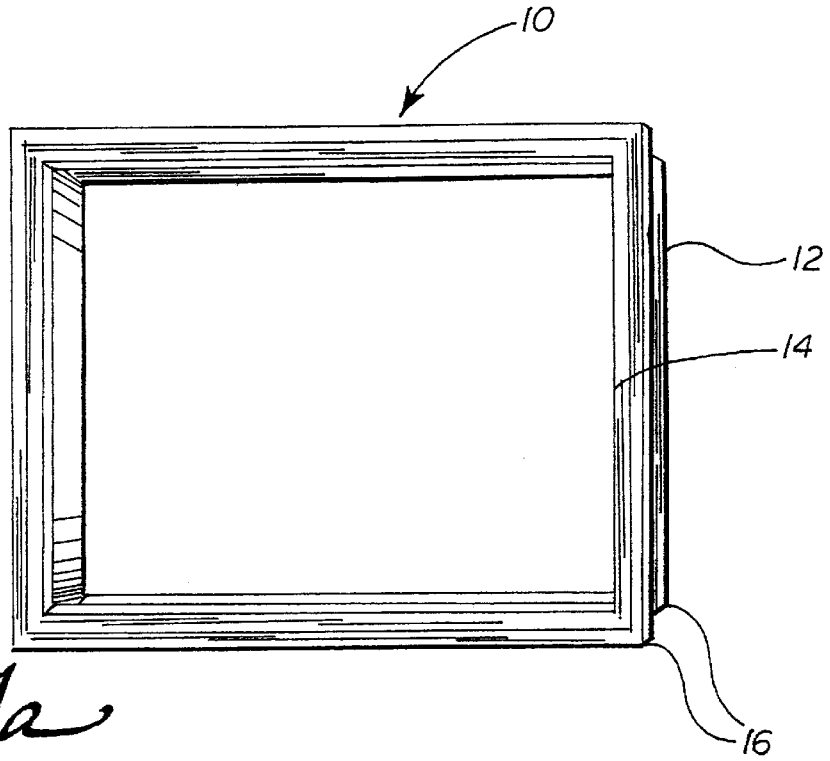
Fig. 1a
Fig. 1b
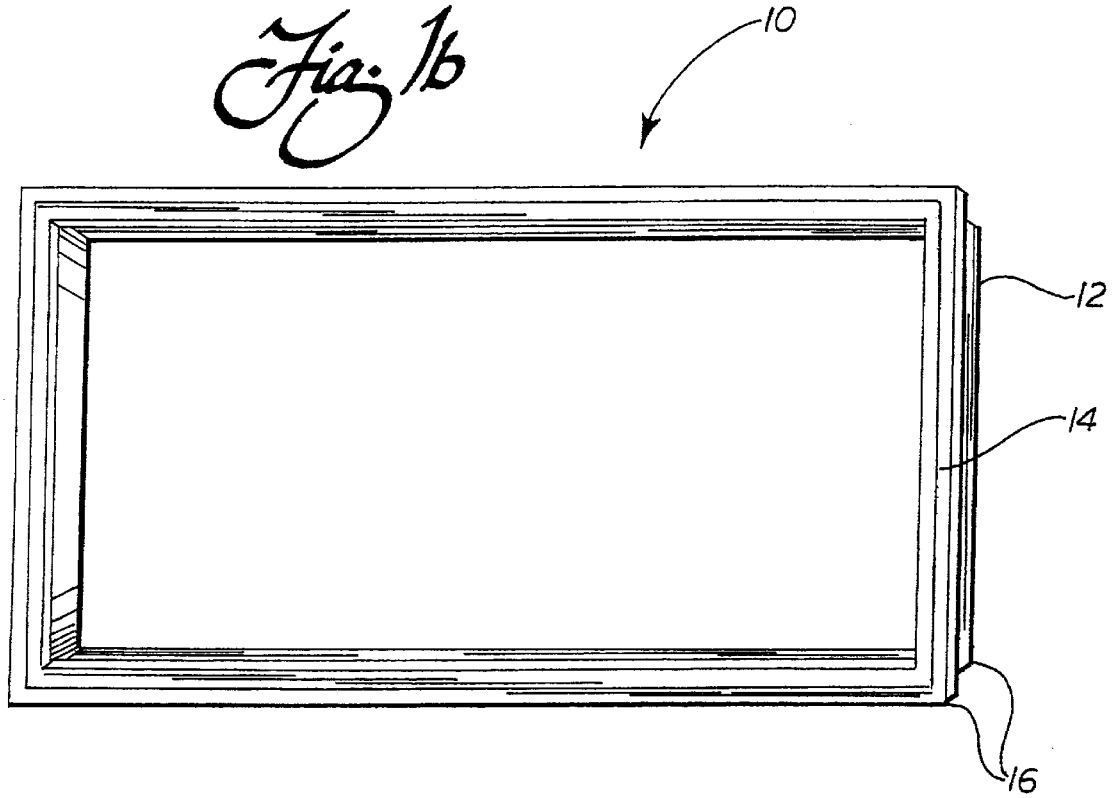

Fig. 2
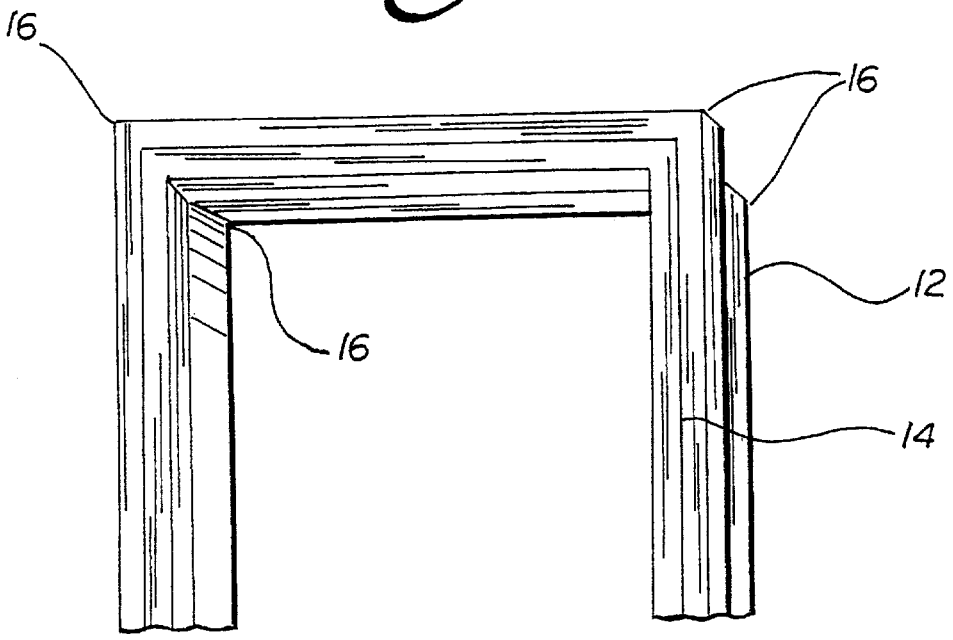
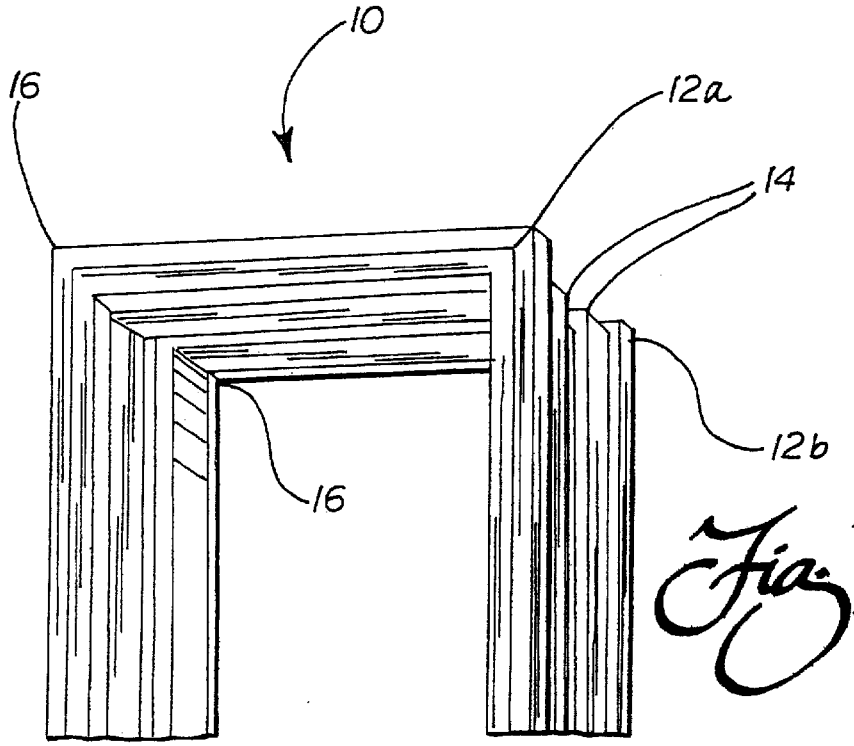
Fig. 3

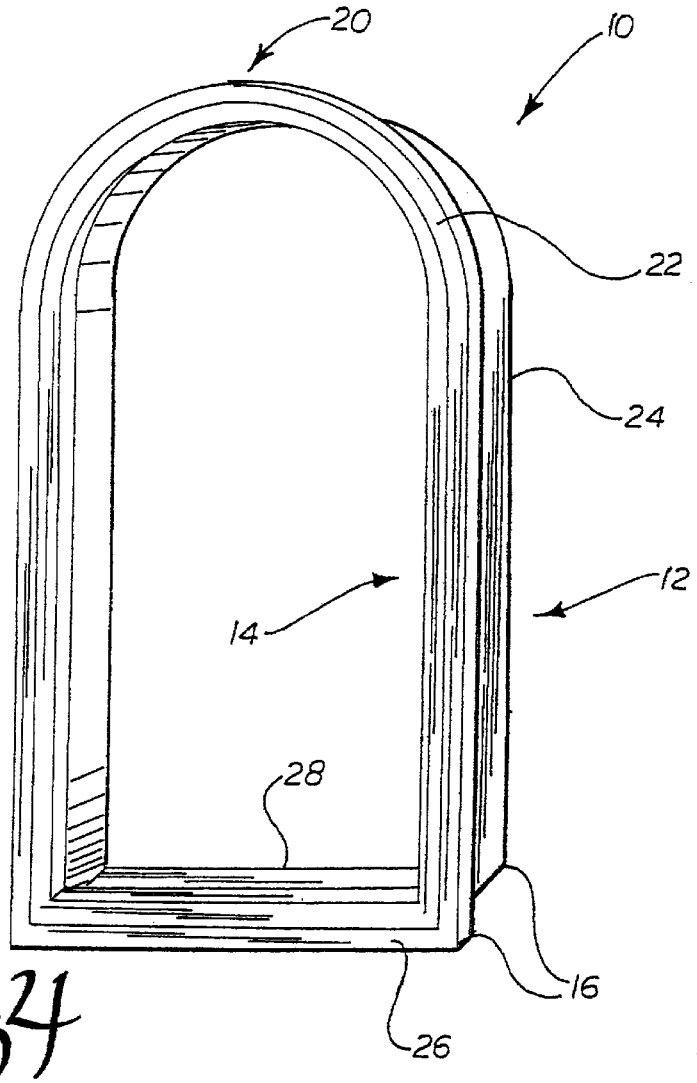
Fig. 4
Fig. 5
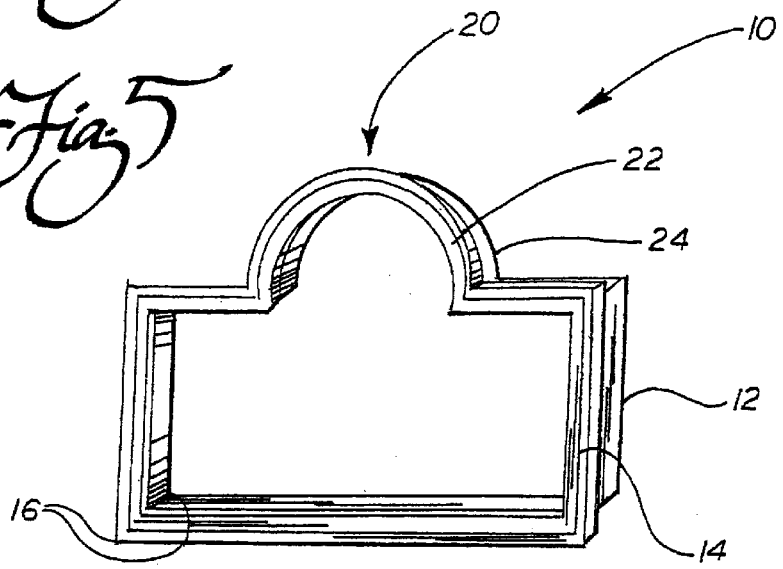

TRIM ASSEMBLY AND METHOD OF MANUFACTURE

This application claims the benefit of U.S. Provisional Application Serial No. 60/052,781 filed Jul. 2, 1997, entitled "Trim Assembly and Method of Manufacture."

TECHNICAL FIELD

The present invention relates generally to the window and door trimming art and, more particularly, to an improved one-piece trim assembly that is easily installed in the interior of wall openings or the like.

BACKGROUND OF THE INVENTION

The application of interior trim around the interior of wall openings, such as those provided for the installation of windows and doors, is well-known in the art. To explain the environment in which the trim is utilized, it is common to place a prefabricated window frame assembly in the opening. However, one significant and recurring problem is that the jamb provided on a standard window frame assembly is not as deep as the framed wall is thick. This, of course leaves an unsightly gap between the frame assembly and the interior wall. To cover this gap and provide an aesthetically pleasing appearance, pieces of interior trim formed of strips of high quality wood or drywall are applied along the interior of the opening and the surrounding wall. In addition to window openings, matching trim is also placed in and around any walk-through door openings in the same room.

It should be appreciated that to provide an attractive and securely fastened trim, several independent steps are required. Typically, completion of the trim is done at the job site, beginning with measuring the window openings. The wood members forming the trim must be cut to provide a custom fit. Such cutting processes involve setting up work tables and the appropriate saws, and further include the use of a miter box to cut the oblique edges that typically form the joints between the trim members. Of course, all measuring and cutting must be completed in a precise manner to ensure an exact fit that provides an aesthetically pleasing appearance. Thus, by necessity, the measuring and cutting operations are time consuming, unforgiving and painstaking processes.

Moreover, after measuring and cutting are complete, the trim pieces must then be fastened around the wall opening. For a rectangular window opening, four jamb return members are first inserted and secured along to the side walls of the window opening. Four casing members are then nailed to the exterior wall surfaces surrounding the opening to cover the gap between the jamb return members and the drywall or other interior wall material. Special care and effort is required when securing these members to ensure the structural integrity of the formed joints and to avoid future cracking and splitting that often results from fluctuations in temperature and humidity, as well as the typical shifting and settling of the structure over time.

After installation is complete, the additional step of providing the trim members with a pleasant outward appearance is required. This generally involves using a wood filler compound to overspread and fill any cracks in the miter joints of both the jamb return members and the casing members. The attached trim members must then be painted or stained to cover the filler material and trim so as to provide the desired "cased" look.

As should be appreciated, the same process is generally used to trim interior walk-through door openings. However, such door openings require the installation of casing on both sides of the opening. This of course significantly increases the amount of work required.

In addition to the standard rectangular openings, it is common for windows and some specialty doors with decorative transoms to have arcuate upper portions that significantly increase the expense of the trimming process. Specialty cut wood members are required to provide the arcuate portion of the trim. Such members are formed using special processing techniques which makes them particularly expensive to manufacture. Also, such curved members must be carefully installed in order to provide the desired, high-quality fit and finish.

Thus, in view of the foregoing, it can be readily appreciated that the process of installing trim on window or door openings requires a significant amount of time, effort and expense to complete. It may take up to three hours for an experienced and skilled craftsman to complete the trimming operation for a single rectangular wall opening. Thus, in a structure with several openings, the entire trimming process could take days to complete. This time and expensive is greatly increased when the openings include arcuate portions. Trimming window and door openings is a labor intensive and expensive undertaking thus, significant overall expense is added to the housing cost.

Previously, others have proposed simplifying the trimming process through the use of preformed trim assemblies for insertion into window/door openings using additional clips or other connecting structure. For example, U.S. Pat. No. 4,972,640 to DiFazio discloses a preassembled window trim unit made of wood or plastic for installation into the interior of a window opening. As should be appreciated, the special mounting clips required for attachment to the window frame limit utilization of this trim to a special, cooperating window frame capable of accepting a series of panels carried by these clips. Furthermore, since all prefabricated window assembly manufacturers do not provide an appropriate structure for mating with such a clip, this does not provide a universal solution (that is, a trim assembly appropriate for use with the prefabricated window assemblies of a number of different manufacturers).

Therefore, there is a need in the art for an improved one-piece trim assembly for placement along the interior of a window or door opening. The assembly would have a simple, yet strong, construction that is easy to secure in a wall opening independent of any additional, specialized modification to the existing prefabricated window or door structure. Additionally, the assembly would be easily formed into different shapes, including shapes having arcuate sides, for use with a wide variety of window/door openings. An improved method for manufacturing the trim assemblies would also be provided, including a method of forming arcuate sections.

SUMMARY OF THE INVENTION

Thus, keeping the above needs for improvement in focus, it is a primary object of the present invention to provide an aesthetically pleasing, preformed one-piece trim assembly that is easily and efficiently installed along the interior of a wall opening independent of any additional structure and, particularly, without modification to the prefabricated window assembly.

Another object is to provide a preformed trim assembly that is easy to mount in a walk-through doorway formed in a wall.

Yet another object is to provide a method of manufacturing a trim assembly from solid cellular foam polyvinyl chloride or polystyrene members, including miter cutting and welding the members together to form a one-piece unit for easy and efficient installation.

An additional object is to provide a method of forming a one-piece trim assembly having arcuate or rounded sections for use in corresponding window or door structures.

Additional objects, advantages and other novel features of the invention will be set forth in part in the description that follows and, in part, will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved trim assembly is provided in a one-piece construction that is easily and efficiently installed in a window opening independent of any window frame or additional window structure. In the preferred embodiment, the one-piece trim assembly is formed in from elongate jamb return and casing members that are interconnected using the present inventive method. In accordance with an important aspect of the present invention, the members of the trim assembly are formed from solid cellular foam polyvinyl chloride or polystyrene, thereby providing a lightweight, yet durable, assembly that is easy and inexpensive to produce.

More particularly describing the trim assembly by way of the method of making the same, a plurality of jamb return and casing members are miter cut along both edges to a predetermined length. The members are selected based on the size and shape of the trim assembly desired, and for purposes of describing the present invention may be considered four elongate pieces of solid cellular foam polyvinyl chloride or polystyrene, thereby forming a rectangular trim assembly. To interconnect the members, the opposed oblique edges of two corresponding jamb return members are secured into welding fixtures. A heating plate is placed adjacent to the oblique edges of both member for a predetermined length of time, after which the heating plate is removed and the members are pressed together to form a heat welded joint. The welding process is repeated, adding additional members to form the desired shape of jamb extension assembly and a matching casing assembly.

After the welding operation is completed, the welded joints in both the jamb return and casing assemblies are thoroughly cleaned to provide an aesthetically pleasing appearance. The cleaning process consists of placing the joint selected for cleaning in a fixture and using cleaning tools or methods that are well-known in the art. While the selected joint is being cleaned, the other joints are maintained at an elevated temperature. This ensures that pliability is retained to facilitate the cleaning operation. After all sides of the welded joints are cleaned, including the external corners, the completed jamb extension assembly and casing assembly are secured together using mechanical or chemical means, thereby forming a one-piece trim assembly.

To install the trim assembly in a window opening, the one-piece assembly is simply aligned with and pressed into the opening until the jamb extension assembly abuts the frame of the window structure and the interior surface of the casing assembly abuts the wall surrounding the window opening. The width and length of the jamb return and casing assembly members are predetermined to insure a proper fit in a variety of standard window openings. The trim assembly is then simply attached to the wall by mechanical means of attachment, such as a nail or screw.

Advantageously, it should be appreciated that the installed trim assembly acts independently of the window frame, and therefore, has wide application in a variety of settings, whether or not a separate window or frame assembly is present. For example, the assembly of the present invention may be used to frame interior walk through doorways or pass through windows. In a walk-through doorway application, a three-sided door trim assembly is provided having separate casing assemblies attached to both sides of the jamb return assembly. Of course, the jamb extension assembly and casing assemblies are constructed using the principles described above for the window casing assembly.

According to another feature of the invention, a composite trim assembly is also provided for use in trimming window openings having arcuate or curved sections. The method used to form the curved sections includes selecting pieces of solid cellular foam polyvinyl chloride or polystyrene to form a jamb return member and a casing member, each corresponding to the pre-determined dimensions of the arcuate portion of the window or door opening. The members are then subjected to a heating process to ensure that sufficient pliability is obtained to permit bending. The heated members are then placed around a jig or similar object having the desired degree of curvature and secured in this curved position. Upon cooling, the curved jamb return and casing members are miter cut and welded as described above to corresponding connection members, thereby forming a trim assembly with an appropriate curved construction. As can be appreciated, the arcuate trim assembly can be incorporated with straight trim assembly pieces to accommodate a wide variety of wall openings.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification illustrate several aspects of the present invention and, together with the description, serve to explain the principles of the invention. In the drawing:

FIGS. 1*a* and 1*b* show perspective views of similar rectangular trim assemblies formed in different sizes for installation in a variety of window openings;

FIG. 2 is a perspective view of a three-sided trim assembly of similar construction for use in a window opening, such as where a sill member or other type of footer is present;

FIG. 3 is a perspective of a trim assembly having a casing assembly disposed on both sides for use in walk-through doorways or the like;

FIG. 4 is a perspective view of a one-piece trim assembly having an upper curved section;

FIG. 5 is a perspective of a generally rectangular trim assembly having a specialized curved section for use in a custom window opening.

Reference will now be made in detail to the present preferred embodiment of the invention, an example of which is illustrated in the accompanying drawing.

DETAILED DESCRIPTION OF THE INVENTION

Figure 1:
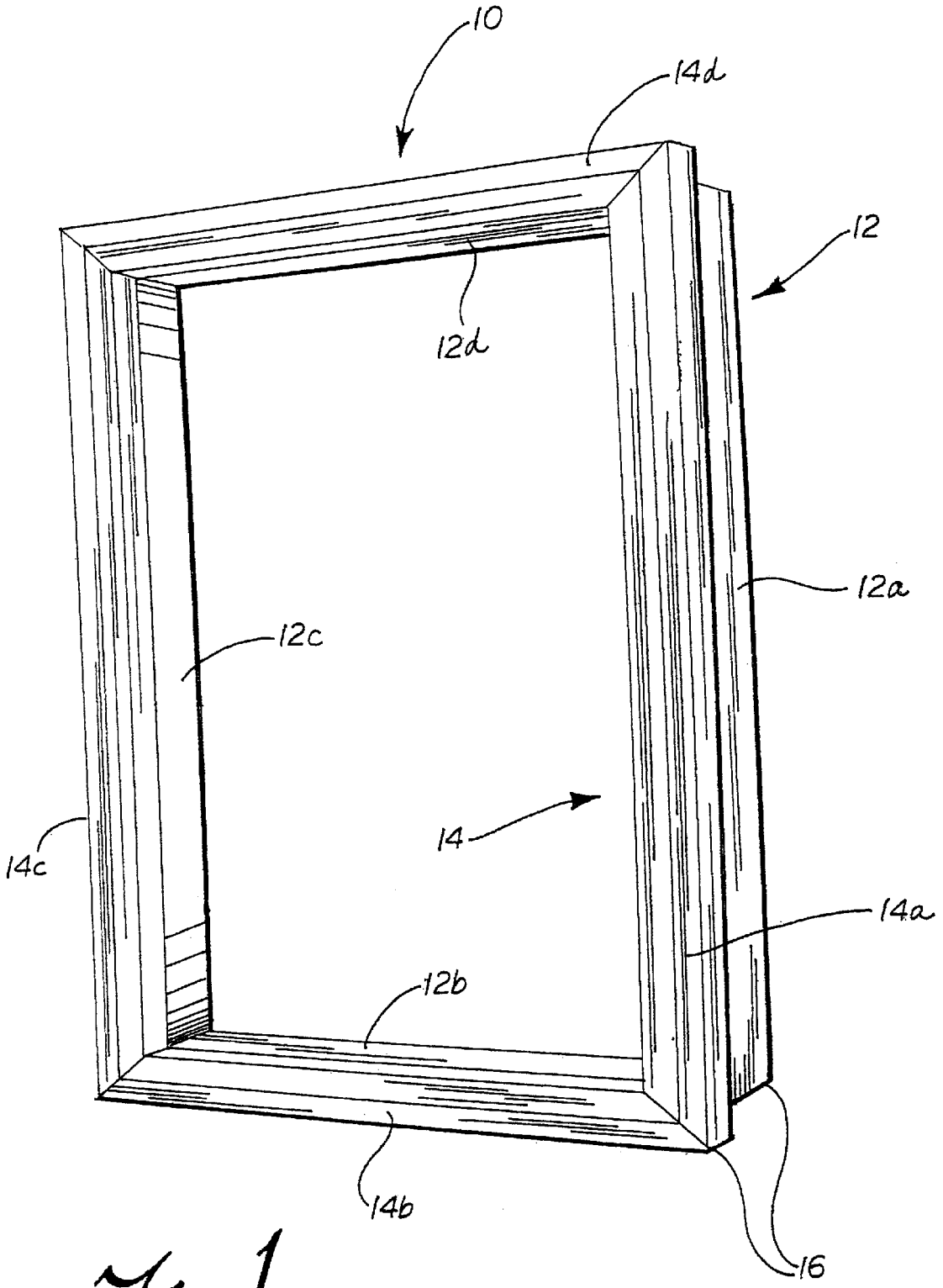
FIG. 1 is a perspective view of a trim assembly for use with a rectangular window frame, showing the jamb extension assembly attached to the casing assembly, and also showing the miter cut, welded, and cleaned corners on the casing assembly side.

Reference is now made to FIG. 1 showing a trim assembly 10 constructed in accordance with the principles described herein. The assembly 10 is formed of a jamb extension assembly 12 and a casing assembly 14. Both the jamb extension assembly 12 and the casing assembly 14 are formed of elongate strips of solid cellular foam polyvinyl chloride or polystyrene welded together along mitered corners to form stable, long-lasting joints 16. As will be appreciated after reviewing the disclosure below, the one-piece trim assembly 10 advantageously provides an easy and inexpensive way to trim the interior of a window opening O (see FIG. 7) without requiring complicated external hardware for attachment to the existing prefabricated window frame or other window structure.

The process of constructing the trim assembly 10 of the present invention involves obtaining the dimensions of the wall opening for trimming. Pieces of solid cellular foam polyvinyl chloride or polystyrene are selected that correspond to the required width of the jamb and the desired width of casing. By way of example, as shown in FIG. 1, the trim assembly 10 includes a jamb extension assembly 12 formed of four jamb extension members 12*a–d* and a casing assembly 14 formed of four casing members 14*a–d*. Of course, it is contemplated that the assemblies are preformed based on standard dimensions of window openings and jamb widths provided by known types of window frame assemblies. Therefore, it should be appreciated that the step of determining the window dimensions may be known without being on-site or without performing measuring for each construction.

The selected pieces 12*a–d*, 14*a–d* are cut across their longitudinal axis to an estimated length. In estimating the length required, a precalculated amount of additional material (about 4 cm) is included to compensate for material loss which invariably occurs during the heat welding process. The ends of the jamb return 12*a–d* and casing members 14*a–d* are then miter cut using techniques well-known in the art. The miter cut is made at an approximate forty-five degree angle such that the oblique edge is provided along the end of each member that corresponds to an oblique edge of the other members. It should be appreciated that with the use of the preferred plastics materials, the miter cut must be made in a rapid fashion (i.e. "rip cut"). This will avoid any excess heating and damage during cutting.

After making the miter cuts, the corresponding ends of both the jamb return 12*a–d* and casing members 14*a–d* are heat welded to form a strong, lasting joint. The welding process involves selecting two corresponding members with opposing oblique edges and placing both in abutment in a spring-clamp welding fixture (not shown). More specifically, the selected members are placed such that the oblique end of each contacts and is mirrored about an axis defined by a positioning plate (not shown).

After any necessary adjustments are made to ensure proper alignment along the mating oblique edges, a clamp is used to secure the respective members in place. The positioning plate is then retracted and a heating plate is inserted between the members. The members are then urged against the plate for a specified period of time necessary to provide the desired degree of melting to permit fusion. Experimentation with various welding times and temperatures reveals that a one to two second duration at a temperature of substantially 220–240° C. provides suitable melting without damaging, decomposing, or deteriorating the solid cellular foam polyvinyl chloride or polystyrene. However, it is possible that other similar materials can be utilized that require greater or lesser temperatures and corresponding contact times. In any event, it should be appreciated that care is required, as excessive heating may cause flashing which produces an unpleasant finish that is difficult or impossible to remove during the cleaning process. Upon reaching the desired degree of melting, the heating plate is retracted and the members are pushed together for approximately five seconds, thus allowing a polymer bond to form between the corners.

Corresponding jamb return 12*a–d* and casing 14*a–d* members are then welded on to the opposite ends of the respective members using the same technique. After the welding process is completed and both the jamb extension assembly 12 and casing assembly 14 are fully constructed, any residue left over from the welding process is cleaned from the joints to provide suitable surfaces for finishing or painting. More particularly describing the cleaning process, the finished jamb extension 12 and casing assemblies 14 are allowed to cool to a suitable cleaning temperature of between, for example, 25–35° C. One of the welded joints is then selected for cleaning and secured in a fixture. Heat lamps are placed over the remaining three joints in order to retain pliability without overheating the joint (i.e. to maintain a material temperature of approximately 25–35°). A scarfing knife, woodworking cutting tool, or a pair of snips are then used to hand trim away the excess flashing and weld degradation. Importantly, all sides of the welds, including the external corners, are cleaned, thereby providing the trim assembly with a clean surface for finishing.

After the welds are cleaned, the casing assembly 14 is aligned on top of the jamb extension 12 assembly and the two are mechanically or chemically secured together. In the preferred embodiment, staples are placed around the perimeter of the casing assembly to attach the casing to the jamb extension assembly 12, thereby forming a one-piece, preformed welded solid cellular foam polyvinyl chloride or polystyrene trim unit ready for installation into a suitably sized wall opening.

Prior to installing the trim assembly in a wall opening, the assembly is preferably painted or stained with the desired finish, thereby avoiding the labor and expense that is associated with performing the painting or staining operation at the job site. Of course, this step may also be performed during the construction of the trim assembly. For example, the individual assemblies may be painted or stained prior to the stapling operation described above.

Figure 7:
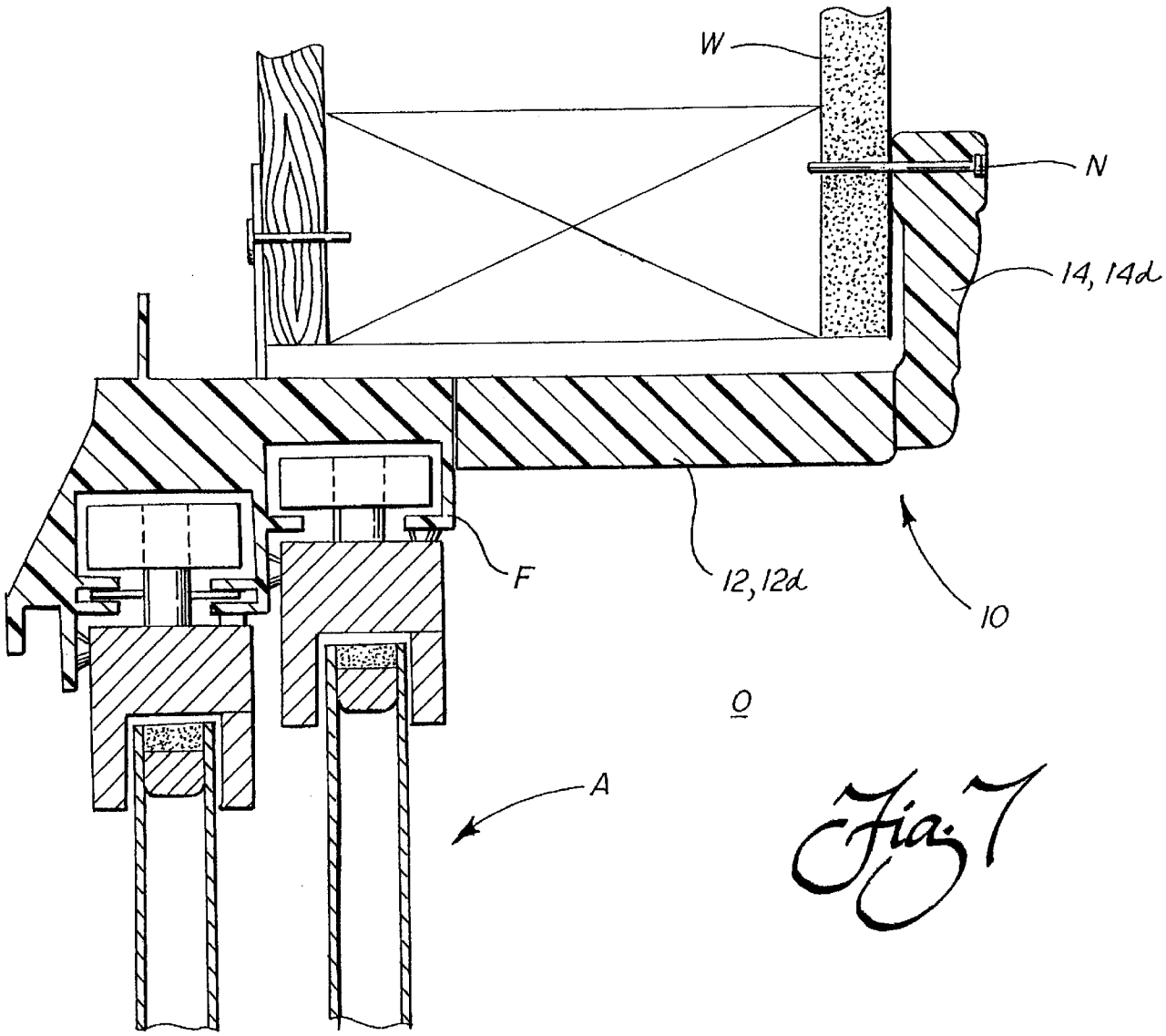
FIG. 7 is a cross-sectional, cutaway view of the one-piece trim assembly of the present invention installed in a window opening adjacent to a window assembly.
Figure 8:
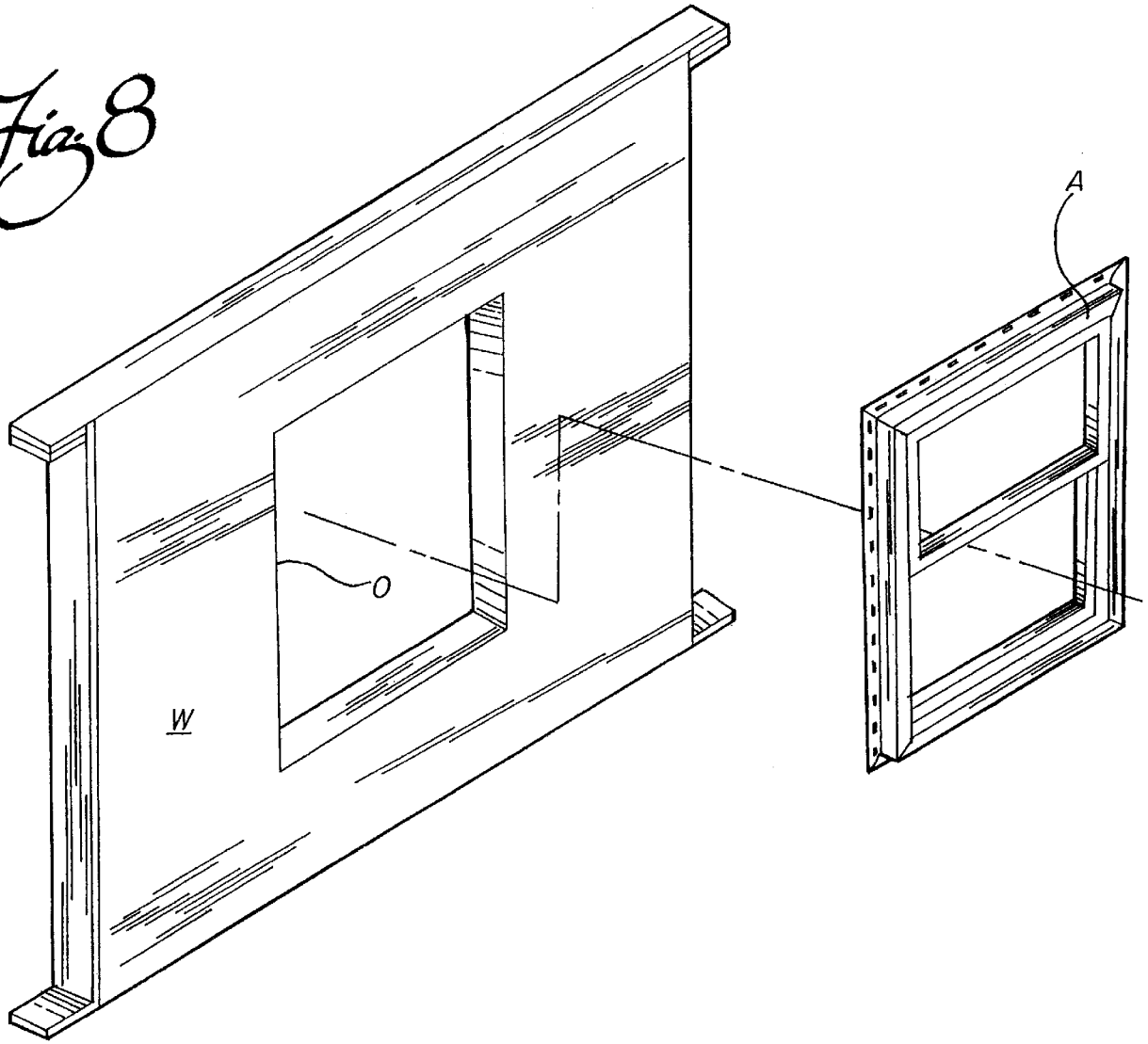
FIG. 8 is a perspective view of the exterior of a wall illustrating the manner in which an exterior window assembly is typically installed in an opening in the wall.
Figure 9:
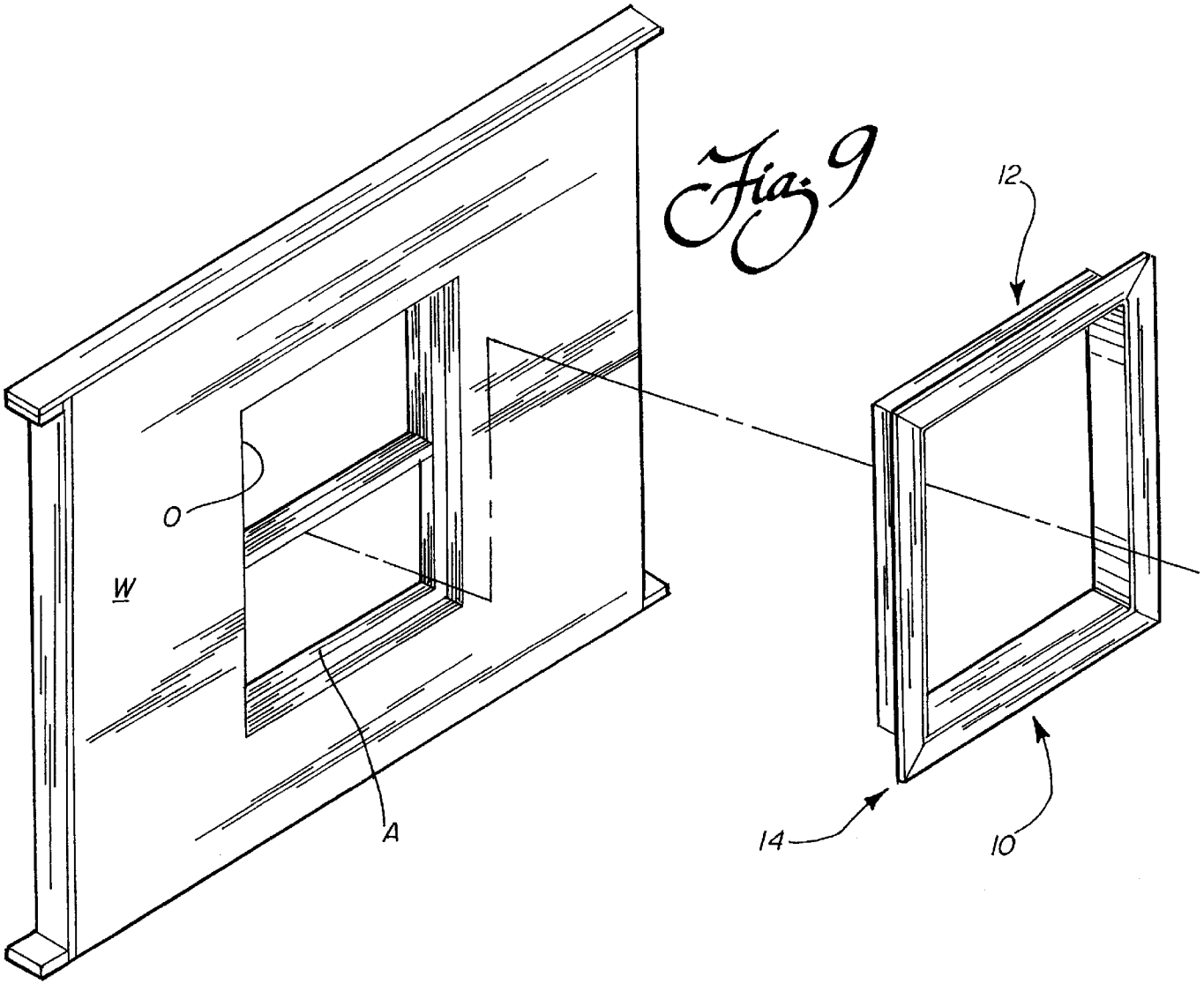
FIG. 9 is a perspective view of the interior of a wall illustrating the manner in which the one-piece trim assembly of the present invention is installed into the interior of the opening in the wall adjacent to the exterior window assembly.

To install the trim assembly 10 into a window opening O, the unit is simply pressed into place so that the interior lateral sides of the jamb extension assembly 12 abut the frame F of the exterior window assembly A (see FIGS. 7–9). The interior lateral surfaces of the casing assembly 14 abut the wall W surrounding the window opening and rest flush against the wall. Nails N or other mechanical means placed at various locations around it assembly 10 are used to securely attach the trim in place. If a particularly clean finish is desired, the nail holes may then be filled with color matched wood filler or caulked and repainted to cover the holes created by the nails.

The trim assembly 10 of the current invention is also suitable for use in a variety of other window and wall openings. As shown in FIG. 2, a three-sided trim assembly 10 is constructed in accordance with the principles outlined above for use in window openings where a sill member or other type of footer exists. In this case, it should be appreciated that the casing assembly 12 and the jamb extension assembly 14 are constructed of only three members each. Of course, this construction requires only two miter cut and welded corner joints 16 for each assembly 10. This embodiment has a broad number of interior applications, such as, for example, installation around garage door openings and wall openings surrounding counter tops, sink tops or the like.

Referring now to FIG. 3, a similar three-sided trim assembly 10 is shown for installation in a walk-through door opening. The three-sided door trim assembly 10 is provided with a similar jamb extension assembly 14 corresponding to the width of the wall opening at the doorway. However, two separate casing assemblies 14 are attached to either side of the jamb extension assembly 12. Of course, the jamb extension assembly 12 and the casing assemblies 14 are constructed in accordance with the methods previously described.

To install the three-sided doorway trim assembly 10, a first selected side is pressed into position on either side of the wall of the doorway opening such that the outer edges of the casing assembly 14 are flush with the exterior sides of the wall opening. To install the top side of the trim assembly 10, the bottom of the opposite leg is grasped and moved toward the interior of the opening, thereby causing the top of the assembly 10 to flex downward. The bottom of the opposite leg is then manipulated until the top aligns with the opening and is pressed into place. The opposite member is then pressed into placed on the wall opening such that the opposite edges of the casing assembly 14 are flush with the wall, thereby completing the installation of the trim assembly 10 in a door opening. Although the tension imparted to the assembly 10 during installation is adequate to secure the assembly about the door opening, finishing nails or other attachments may be placed around the perimeter of the casing to ensure a secure and lasting attachment.

The trim assembly 10 is also easily adapted for use in windows having arcuate sections. Examples of such assemblies 10 are illustrated in FIGS. 4 and 5. The trim assembly 10 has a curved section 20 formed from a curved casing member 22 and curved jamb return member 24. In the embodiment shown in FIG. 4, the curved casing member 22 is miter cut and welded to the similarly cut edges of a connecting casing member 26, thereby forming the casing assembly 14. Similarly, a curved jamb return member 24 is cut and welded to a connecting jamb return member 28 to form a jamb extension assembly 12. The casing assembly 14 is then secured over the jamb extension assembly 12 in the manner previously described.

The method of manufacturing the curved casing 22 and jamb return members 24 includes measuring the curved portion of the window opening and selecting appropriate sections of solid cellular polyvinyl chloride or polystyrene to form each respective member. After cutting the selected members to the required length, both the jamb return member 24 and the casing member 22 are subjected to a heating process to increase the pliability of the material. This process includes placing the members on a conveyor belt and passing them through an oven. In the preferred method, the members 22,24 are passed through the oven two times with the interior portions facing upward. The heated members are then turned such that the interior portions face downward and three passes are made. This is done to protect the finish on the portions of the members that are exposed to the interior of the room. The exact temperature and duration required to impart the required degree of pliability for permanent plastic deformation is easily determined by experimentation for the particular size, thickness, and type of material utilized.

After the material reaches the required state of pliability, the members 22, 24 are removed from the oven and placed around jigs cut to the desired degree of curvature. The members are then set in the jigs and allowed to cool. The curved casing 22 and jamb return 24 members are then ready to be formed into a trim assembly 10.

The method of constructing the trim assembly 10 having a curved section is similar to that previously disclosed. As with the rectangular assemblies described above, the bottom ends of a curved portion are miter cut. The straight connecting members are similarly cut so as to correspond to the oblique edges of the curved casing 22 and jamb return 24 members. Welds are then made at each of the corners to form the joints 16 for both the jamb extension assembly 12 and the casing assembly 14, respectively. The separate assemblies are then painted or stained and placed on top of each other for attachment as described above.

Figure 6A:
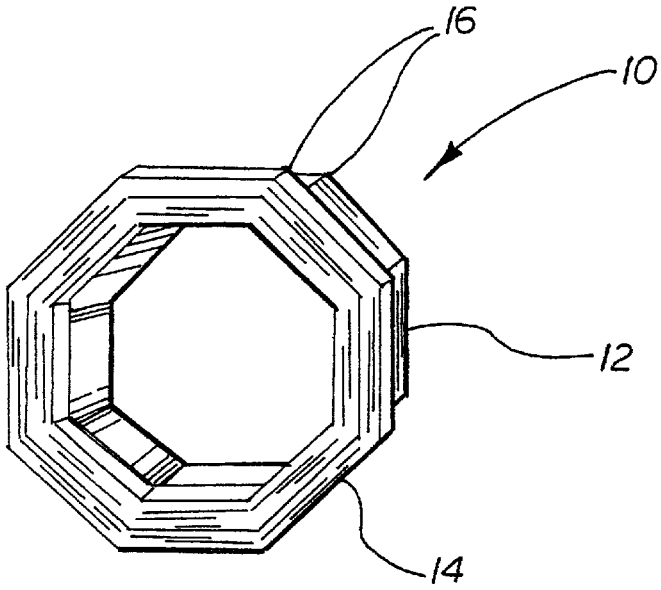
FIG. 6*a* is a perspective of a trim assembly for installation in an octagonal window opening.
Figure 6B:
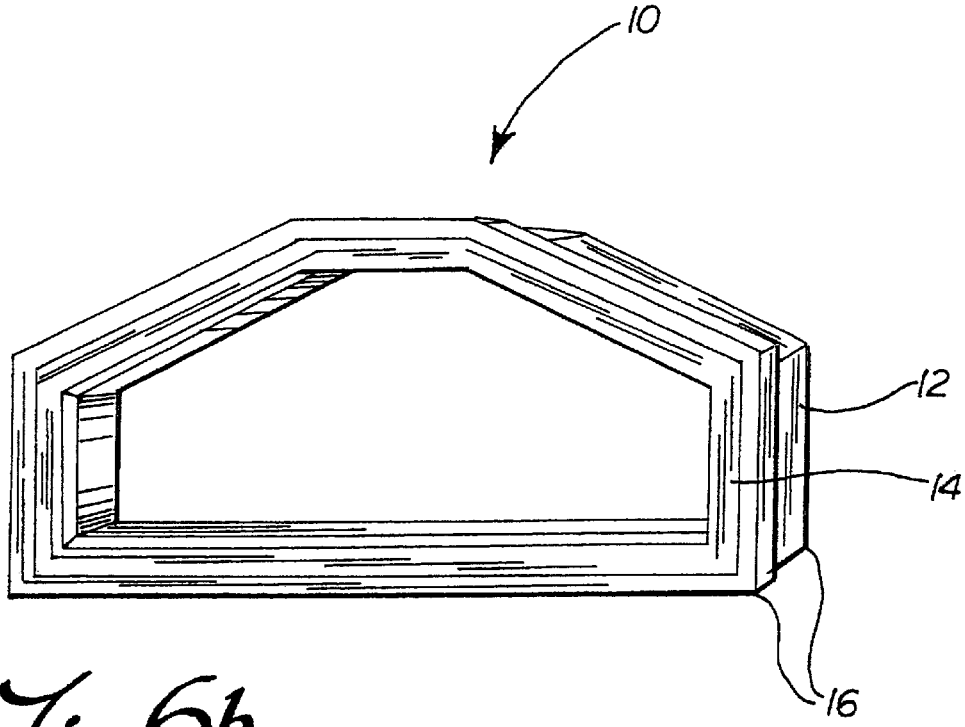
FIG. 6*b* is a perspective of a trim assembly for installation in a pentagonal window opening.

As illustrated in FIG. 5, the trim assembly 10 may also be constructed having a curved portion in conjunction with more than one connecting portion. Likewise, it is within the broadest aspects of the present invention to provide a trim assembly 10 in a variety of polygonal shapes, such as the octagonal trim assembly 10 shown in FIG. 6*a*, and the pentagonal trim assembly 10 shown in FIG. 6*b*.

In summary, an improved, one-piece trim assembly 10 is provided for installation in a wall opening, such as a recessed window frame or walk-through doorway. The trim assembly includes a jamb extension assembly 12 for covering the interior surface of the wall opening and one or more casing assemblies 14 for covering the wall at one or both sides of the wall opening. Both the jamb extension assembly 12 and casing assembly 14 are made of solid cellular foam polyvinyl chloride (PVC) or polystyrene members having miter cut and welded corners. The specific material allows for the construction of a strong, yet lightweight pre-finished one-piece assembly for easy and efficient installation in a window or door opening independent of any window or door structure. A method for manufacturing the trim assembly and curved portions thereof is also provided.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. A method of manufacturing a one-piece trim assembly for insertion in the interior of a wall opening adjacent to an exterior window assembly held therein, comprising the steps of:

selecting pieces of solid cellular foam polyvinyl chloride or polystyrene corresponding to the dimensions of said wall opening to form jamb return members for covering at least a portion of an interior surface of the wall opening and casing members for covering at least a portion of an interior surface surrounding the wall opening;

cutting both ends of said jamb return members and said casing members to a predetermined length;

attaching the corresponding ends of said jamb return members together to form a jamb extension assembly;

attaching the corresponding ends of said casing members to form a casing assembly;

aligning said casing assembly on top of said jamb extension assembly; and affixing said casing assembly to said jamb return assembly to form a single one-piece trim assembly, whereby the one-piece trim assembly can be installed into a wall opening adjacent to the window assembly or the like independent of any additional structure.

2. The method of claim 1, wherein said attaching steps are completed by welding.

3. The method of claim 2, wherein said predetermined length includes a calculated additional length to compensate for material loss during welding.

4. The method of claim 1, wherein the steps of affixing said jamb return members and said casing members includes:

selecting a pair of said jamb return members or said casing members for welding;

securing the corresponding ends of said selected pair of members in a welding fixture;

warming a heating plate to a temperature of substantially 220–240° C.;

positioning said heating plate against the end of each member simultaneously;

retracting said heating plate and pressing the heated ends of said members together.

5. The method of claim 2, further including the steps of:

selecting a welded joint for cleaning;

securing the welded joint in a fixture;

warming the remaining welded joints; and removing the excess material from the selected welded joint;

whereby each of said joints are cleaned by rotating said trim assembly through said fixture.

6. The method of claim 4, including the step of removing excess material from the external corners of said casing assembly.

7. The method of claim 5, wherein said warming is provided by a heating lamp which maintains said welded joint at a temperature of substantially 25–35° C.

8. A one-piece trim assembly for affixation to the interior of a wall opening adjacent an exterior window assembly installed therein, comprising:

a casing assembly for covering at least a portion of the wall surrounding the wall opening, said casing assembly formed from a plurality of elongate casing members, each of said casing members having cut ends that are attached to a respective corresponding casing member;

a jamb extension assembly for covering at least a portion of an interior surface of the wall opening, said jamb extension assembly formed from a plurality of jamb return members, each of said jamb return members having cut ends that are attached to a respective corresponding jamb return member; and means for connecting said casing assembly to said jamb extension assembly;

whereby the one-piece trim assembly thus formed is installed in the wall opening adjacent to the exterior window assembly or the like without additional hardware or attachment to a prefabricated structure held therein.

9. The trim assembly according to claim 8, wherein said jamb assembly is affixed to said casing assembly in a substantially perpendicular fashion.

10. The trim assembly according to claim 8, wherein said jamb return members and said casing members are formed from the group consisting of solid cellular foam polyvinyl chloride (PVC) or polystyrene.

11. A method of installing a window assembly in a wall opening and trimming the window assembly once installed, comprising the steps of:

attaching a window assembly to the exterior of the wall opening; and attaching a preformed one-piece trim assembly comprised of a casing assembly and a jamb extension assembly connected together by connecting means in the interior of the wall opening in an abutting relationship with the window assembly such that the jamb extension assembly covers at least a portion of the interior surface between the wall opening and the exterior window assembly and the casing assembly covers at least a portion of the wall surrounding said opening.

* * * * *